US011003130B1

(12) United States Patent
Otsuka

(10) Patent No.: US 11,003,130 B1
(45) Date of Patent: May 11, 2021

(54) EXPOSURE DEVICE AND IMAGE FORMING APPARATUS

(71) Applicant: TOSHIBA TEC KABUSHIKI KAISHA, Tokyo (JP)

(72) Inventor: Takuya Otsuka, Sunto Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/992,178

(22) Filed: Aug. 13, 2020

(30) Foreign Application Priority Data

Mar. 2, 2020 (JP) ..... JP2020-035096

(51) Int. Cl.
*G03G 21/16* (2006.01)
*G03G 15/04* (2006.01)

(52) U.S. Cl.
CPC ... *G03G 21/1661* (2013.01); *G03G 15/04045* (2013.01)

(58) Field of Classification Search
CPC ..... G03G 21/1666; G03G 2221/1636; G03G 15/04054; G03G 21/1853; G03G 15/04045
See application file for complete search history.

(56) References Cited

U.S. PATENT DOCUMENTS

2009/0169261 A1* 7/2009 Yokoi ..... G03G 15/04036 399/220
2012/0114374 A1* 5/2012 Suzuki ..... G03G 15/04 399/111
2013/0259521 A1* 10/2013 Sugiyama ..... G03G 21/1666 399/110
2018/0173132 A1* 6/2018 Tsukada ..... G03G 15/04054
2019/0129327 A1 5/2019 Aruga et al.

FOREIGN PATENT DOCUMENTS

JP 2000-158749 6/2000
JP 2006-069061 3/2006

* cited by examiner

*Primary Examiner* — Walter L Lindsay, Jr.
*Assistant Examiner* — Jessica L Eley
(74) *Attorney, Agent, or Firm* — Amin, Turocy & Watson, LLP

(57) ABSTRACT

According to one embodiment, the exposure device includes an exposure head, a holder, a biasing member, a lifting mechanism, a support member, a harness, and a protrusion. The holder supports the exposure head movably in a first direction of approaching the photosensitive drum and a second direction of being spaced from the photosensitive drum. The harness has one end portion connected to the exposure head. The harness is positioned with respect to the support member in a positioning location having a length direction position different from that of the one end portion. The harness has a folding portion formed between the one end portion and the positioning location. The protrusion enters inside of the folding portion to regulate movement of the folding portion of the harness in the first direction or the second direction. The protrusion protrudes from the holder in a third direction intersecting the first direction.

20 Claims, 7 Drawing Sheets

EXPOSURE DEVICE AND IMAGE FORMING APPARATUS

CROSS-REFERENCE TO RELATED APPLICATION

This application is based upon and claims the benefit of priority from Japanese Patent Application No. 2020-035096, filed Mar. 2, 2020, the entire contents of which are incorporated herein by reference.

FIELD

Exemplary embodiments described herein relate to an exposure device and an image forming apparatus.

BACKGROUND

For example, an exposure device of an image forming apparatus includes an exposure head, a harness, a holder, and a biasing member. The harness is a signal line for sending a drive signal or the like to the exposure head. The harness is connected to the exposure head. The holder holds the exposure head. The biasing member applies a load to the exposure head in a direction of approaching a photosensitive drum. In order to accurately position the exposure head, it is required to apply an appropriate load to the exposure head.

In the exposure device, the harness is connected to the exposure head, and thus the load applied to the exposure head may be inaccurate due to the influence of the harness.

DETAILED DESCRIPTION

Figure 1:
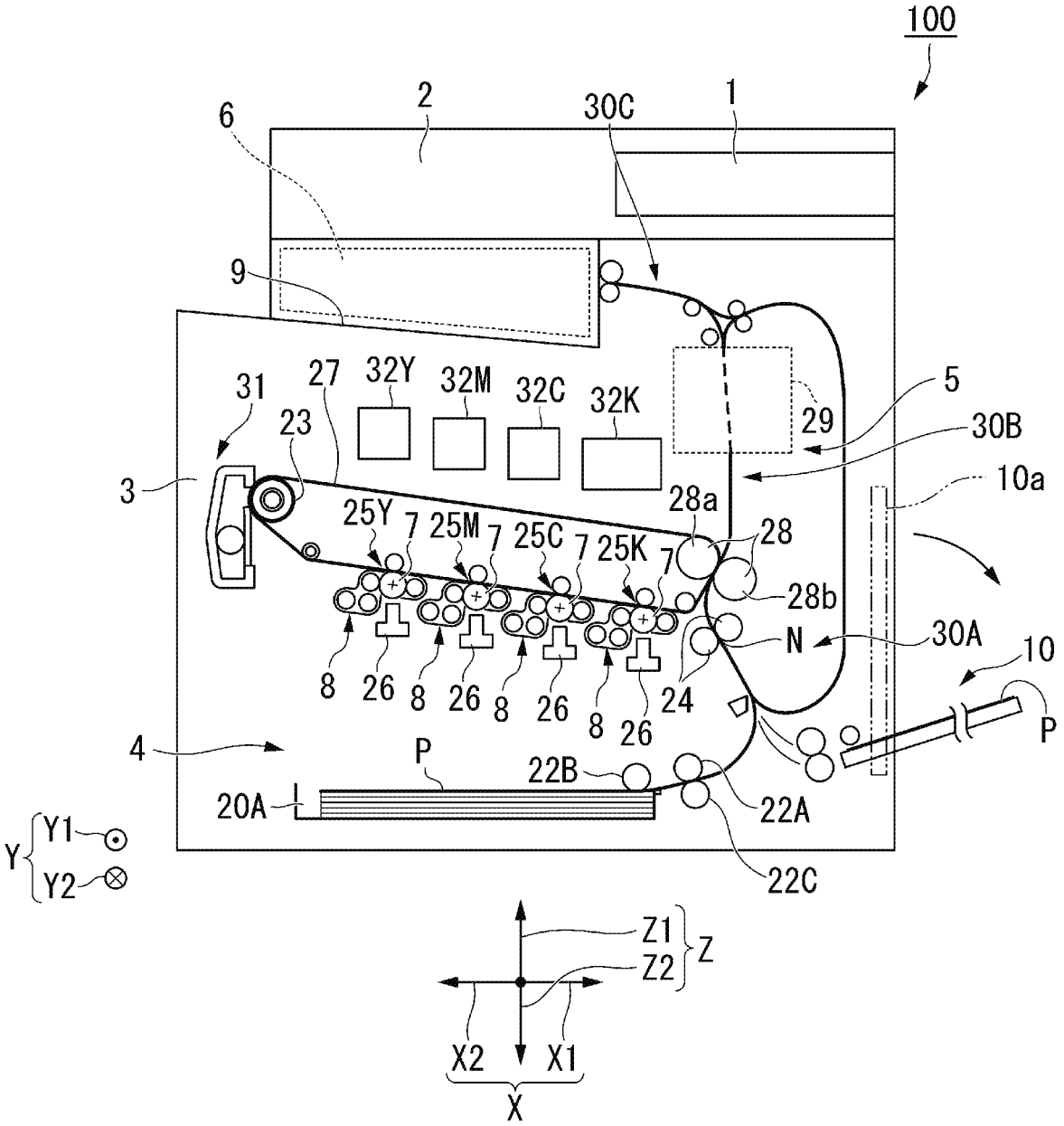
FIG. 1 is a schematic cross-sectional view showing a configuration example of an image forming apparatus of the embodiment.

The exemplary embodiment provides an exposure device and an image forming apparatus capable of accurately determining a load applied to an exposure head.

In general, according to one embodiment, the exposure device includes an exposure head, a holder, a biasing member, a lifting mechanism, a support member, a harness, and a protrusion. The exposure head performs exposure in order to draw an electrostatic latent image on a photosensitive drum. The holder supports the exposure head movably in a first direction of approaching the photosensitive drum and a second direction of being spaced from the photosensitive drum. The biasing member exerts a reaction force to the holder to bias the exposure head in the first direction. The lifting mechanism moves the holder in the first direction and the second direction. The support member supports the lifting mechanism. The harness has one end portion connected to the exposure head. The harness is positioned with respect to the support member in a positioning location having a length direction position different from that of the one end portion. The harness has a folding portion formed between the one end portion and the positioning location. The protrusion enters inside of the folding portion to regulate movement of the folding portion of the harness in the first direction or the second direction. The protrusion protrudes from the holder in a third direction intersecting the first direction.

Hereinafter, an exposure device and an image forming apparatus of the embodiment will be described with reference to the drawings. Unless otherwise specified, in each of the following drawings, the same reference numerals are given to the same or corresponding configurations.

FIG. 1 is a schematic cross-sectional view showing a configuration example of an image forming apparatus of the embodiment.

As shown in FIG. 1, an image forming apparatus 100 of the present embodiment includes a control panel 1, a scanner unit 2, a printer unit 3, a sheet supply unit 4, a conveyance unit 5, a manual feed unit 10, and a control unit 6.

Hereinafter, when referring to the relative position in the image forming apparatus 100, an X1 direction, an X2 direction, a Y1 direction, a Y2 direction, a Z1 direction, and a Z2 direction shown in the drawings may be used. The X1 direction is a direction from left to right when standing in front of the image forming apparatus 100 (on the front side of the paper surface in FIG. 1). The X2 direction is an opposite direction to the X1 direction. The Y1 direction is a direction from the back to the front of the image forming apparatus 100. The Y2 direction is an opposite direction to the Y1 direction. The Z1 direction is a vertically upward direction. The Z2 direction is a vertically downward direction. When the directions of the X1 (Y1, Z1) direction and the X2 (Y2, Z2) direction do not matter or both directions are included, the directions are simply referred to as the X (Y, Z) direction.

A plane having a normal line in the X direction is referred to as a YZ plane. A plane having a normal line in the Y direction is referred to as a ZX plane. A plane having a normal line in the Z direction is referred to as an XY plane. The ZX plane is a plane parallel to a conveyance direction of a sheet P in the image forming apparatus 100. The XY plane is a horizontal plane. Unless otherwise specified, the shape of each member of the image forming apparatus 100 is described based on the disposition posture in the image forming apparatus 100.

The control panel 1 operates the image forming apparatus 100 by an operation of a user.

The scanner unit 2 reads image information of an object to be copied as brightness and darkness of light. The scanner unit 2 outputs the read image information to the printer unit 3.

The printer unit 3 forms an image on the sheet P based on image information from the scanner unit 2 or the outside. The printer unit 3 forms an output image (toner image) with a developer containing toner. The printer unit 3 transfers a toner image to the surface of the sheet P. The printer unit 3 applies heat and pressure to a toner image on the surface of the sheet P to fix the toner image to the sheet P.

The sheet supply unit 4 supplies the sheets P to the printer unit 3 one by one at the timing of the formation of the toner image by the printer unit 3. The sheet supply unit 4 has a paper feeding cassette 20 and a cassette paper feeding unit 21.

The paper feeding cassette 20 stores the sheets P of various sizes. The cassette paper feeding unit 21 is above the end of the paper feeding cassette 20 in the X1 direction. The cassette paper feeding unit 21 has a pickup roller 22B, a paper feed roller 22A, and a separation roller 22C.

The pickup roller 22B conveys the sheet P required for forming an image from the paper feeding cassette 20 to a nip portion between the paper feed roller 22A and the separation roller 22C. The paper feed roller 22A conveys the sheet P conveyed to the nip portion to the conveyance unit 5. The separation roller 22C separates one sheet P when the plurality of the sheets P are conveyed.

The conveyance unit 5 has a registration roller 24. The registration roller 24 aligns a leading end of the sheet P fed by the paper feed roller 22A at a nip N. The registration roller 24 conveys the sheet P at the timing when the printer unit 3 transfers the toner image to the sheet P. The registration roller 24 conveys the sheet P toward a transfer unit 28.

The printer unit 3 has image forming units 25Y, 25M, 25C, and 25K, exposure devices 26, an intermediate transfer belt 27, the transfer unit 28, a fixing device 29, and a transfer belt cleaning unit 31.

The image forming units 25Y, 25M, 25C, and 25K are arranged in this order in the X1 direction. Each of the image forming units 25Y, 25M, 25C, and 25K forms a toner image to be transferred to the sheet P on the intermediate transfer belt 27. The image forming units 25Y, 25M, 25C, and 25K each have the photosensitive drum 7. The image forming units 25Y, 25M, 25C, and 25K respectively form toner images of yellow, magenta, cyan, and black on the photosensitive drums 7.

A charger, the exposure device 26, a developing device 8, a primary transfer roller, a cleaning unit, and a static eliminator are installed around each of the photosensitive drums 7. The primary transfer rollers face the photosensitive drums 7. The intermediate transfer belt 27 is sandwiched between the primary transfer rollers and the photosensitive drums 7.

Toner cartridges 32Y, 32M, 32C, and 32K are installed above the image forming units 25Y, 25M, 25C, and 25K. The toner cartridges 32Y, 32M, 32C, and 32K contain toner of yellow, magenta, cyan, and black, respectively. Each kind of the toner in the toner cartridges 32Y, 32M, 32C, and 32K are supplied to the image forming units 25Y, 25M, 25C, and 25K by a toner replenishment pipe (not shown).

The exposure devices 26 radiate each charged surface of the photosensitive drums 7 with light. Emission of the light is controlled based on image information. The exposure device 26 of the present embodiment has a light source in which a plurality of light emitting elements are arranged in the Y1 direction. In the example shown in FIG. 1, the exposure devices 26 are installed under the image forming units 25Y, 25M, 25C, and 25K.

The image information corresponding to yellow, magenta, cyan, and black is supplied to each of the exposure devices 26. Each of the exposure devices 26 forms an electrostatic latent image on each surface of the photosensitive drums 7, based on the image information.

The intermediate transfer belt 27 is formed with an endless belt. Tension is applied to the intermediate transfer belt 27 by a plurality of rollers that are in contact with an inner peripheral surface. The intermediate transfer belt 27 is stretched flat. The inner peripheral surface of the intermediate transfer belt 27 is in contact with a support roller 28*a* at a position in the X1 direction which is the most spaced in a stretching direction. The inner peripheral surface of the intermediate transfer belt 27 is in contact with a transfer belt roller 23 at a position in the X2 direction which is the most spaced in the stretching direction.

The support roller 28*a* forms a portion of the transfer unit 28. The support roller 28*a* guides the intermediate transfer belt 27 to the secondary transfer position.

The transfer belt roller 23 guides the intermediate transfer belt 27 to a cleaning position.

The image forming units 25Y, 25M, 25C, and 25K excluding the primary transfer rollers are installed in this order in the X1 direction on the lower side of the intermediate transfer belt 27 in the drawing. The image forming units 25Y, 25M, 25C, and 25K are installed in an area between the transfer belt roller 23 and the support roller 28*a* with a gap therebetween.

When the toner image reaches the primary transfer position, a transfer bias is applied to each of the primary transfer rollers of the image forming units 25Y, 25M, 25C, and 25K. Each primary transfer roller primarily transfers the toner image on the surface of each of the photosensitive drums 7 to the intermediate transfer belt 27.

In the intermediate transfer belt 27, the transfer unit 28 is installed at a position adjacent to the image forming unit 25K. The transfer unit 28 includes the support roller 28*a* and a secondary transfer roller 28*b*. The intermediate transfer belt 27 is sandwiched between the secondary transfer roller 28*b* and the support roller 28*a*. The position where the secondary transfer roller 28*b* and the intermediate transfer belt 27 are in contact with each other is a secondary transfer position. The transfer unit 28 transfers the toner image charged on the intermediate transfer belt 27 to the surface of the sheet P at the secondary transfer position. The transfer unit 28 applies the transfer bias to the secondary transfer position. The transfer unit 28 transfers the toner image on the intermediate transfer belt 27 to the sheet P by the transfer bias.

The fixing device 29 applies heat and pressure to the sheet P. The fixing device 29 fixes the toner image transferred to the sheet P by the heat and the pressure. The fixing device 29 is installed above the transfer unit 28.

The transfer belt cleaning unit 31 faces the transfer belt roller 23. The intermediate transfer belt 27 is sandwiched in the transfer belt cleaning unit 31. The transfer belt cleaning unit 31 scrapes off the toner on the surface of the intermediate transfer belt 27.

Conveyance paths 30A and 30B for conveying the sheet P from in this order a lower side toward an upper side are formed respectively between the registration roller 24 and the transfer unit 28 and between the transfer unit 28 and the fixing device 29. Each of the conveyance paths 30A, 30B, and 30C includes a conveyance guide portion and a conveyance roller that face each other with the sheet P sandwiched therebetween.

The manual feed unit 10 supplies the sheet P on which the image is formed to the printer unit 3. When a manual feed tray 13 is used, as shown by a solid line, the manual feed tray 13 is opened by being rotated clockwise in the drawing. The sheets P of various sizes can be placed on the opened manual feed tray 13.

The manual feed unit 10 includes a pickup roller, a paper feed roller, and a separation roller in the same manner as in the sheet supply unit 4.

The control unit 6 controls the entire body and each device portion of the image forming apparatus 100. For example, the control unit 6 controls the control panel 1, the scanner unit 2, the printer unit 3, the sheet supply unit 4, the conveyance unit 5, and the manual feed unit 10, conveys the sheet P, and forms an image to the sheet P. For example, a processor such as a central processing unit (CPU) may be used as the control unit 6.

The detailed configuration of each of the exposure devices 26 will be described. The configurations of the exposure devices 26 are the same as each other. When the image forming units 25Y, 25M, 25C, and 25K are not distinguished from each other, the image forming units 25Y, 25M, 25C, and 25K are referred to as the image forming units 25.

Figure 2:
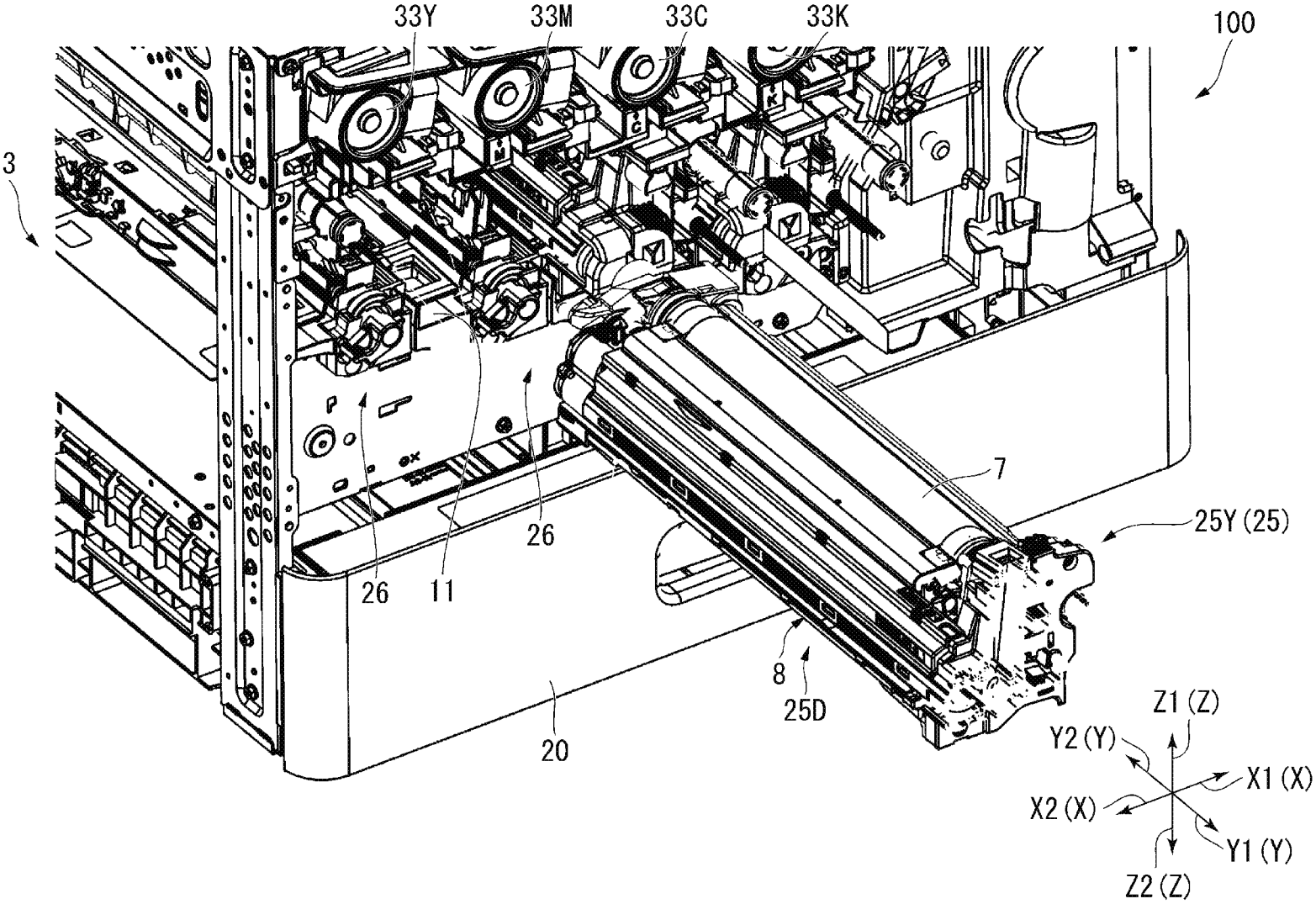
FIG. 2 is a perspective view showing a state where the photosensitive drum unit is pulled out in the image forming apparatus of the embodiment.
Figure 3:
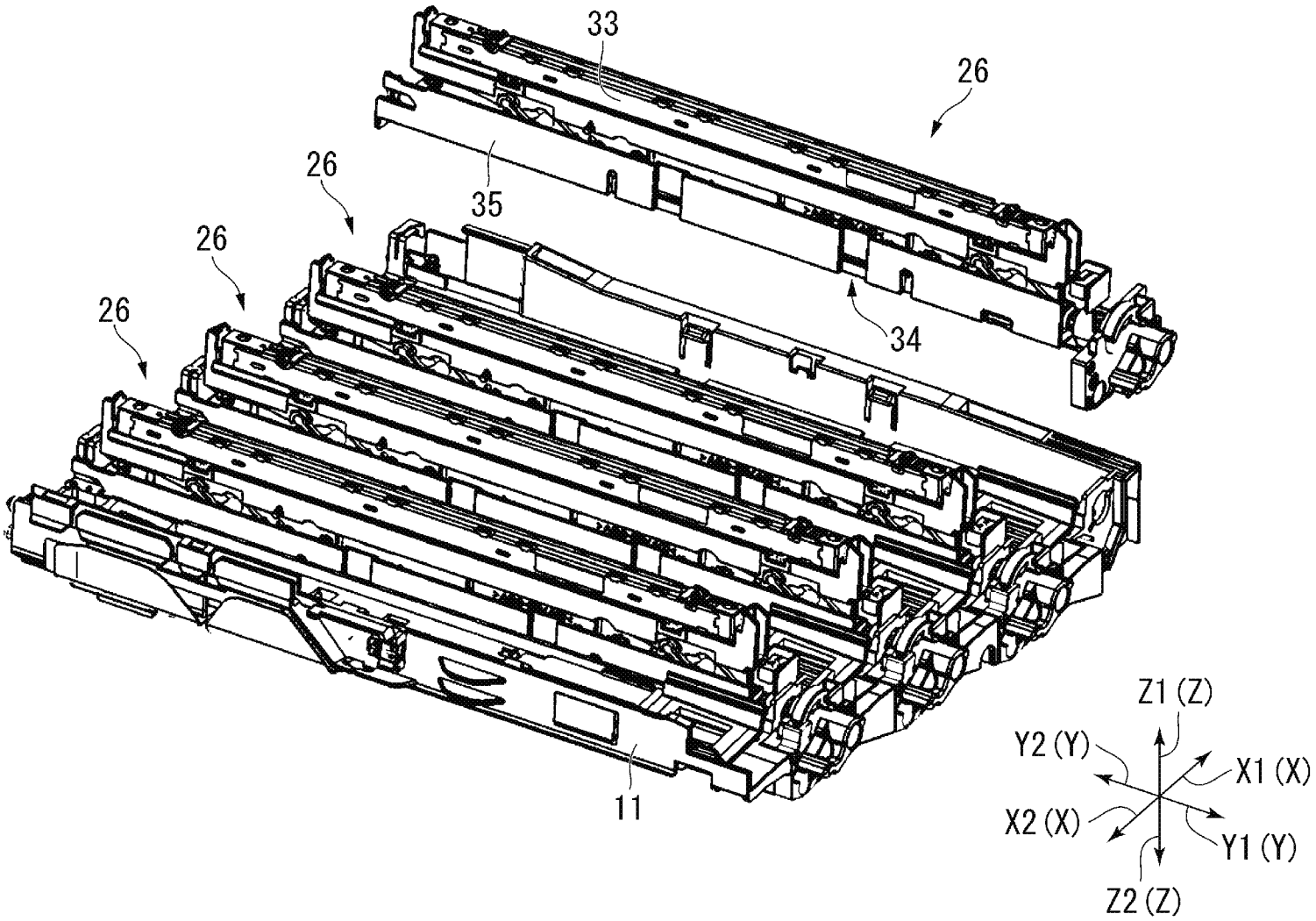
FIG. 3 is a perspective view of an exposure device and a base.
Figure 4:
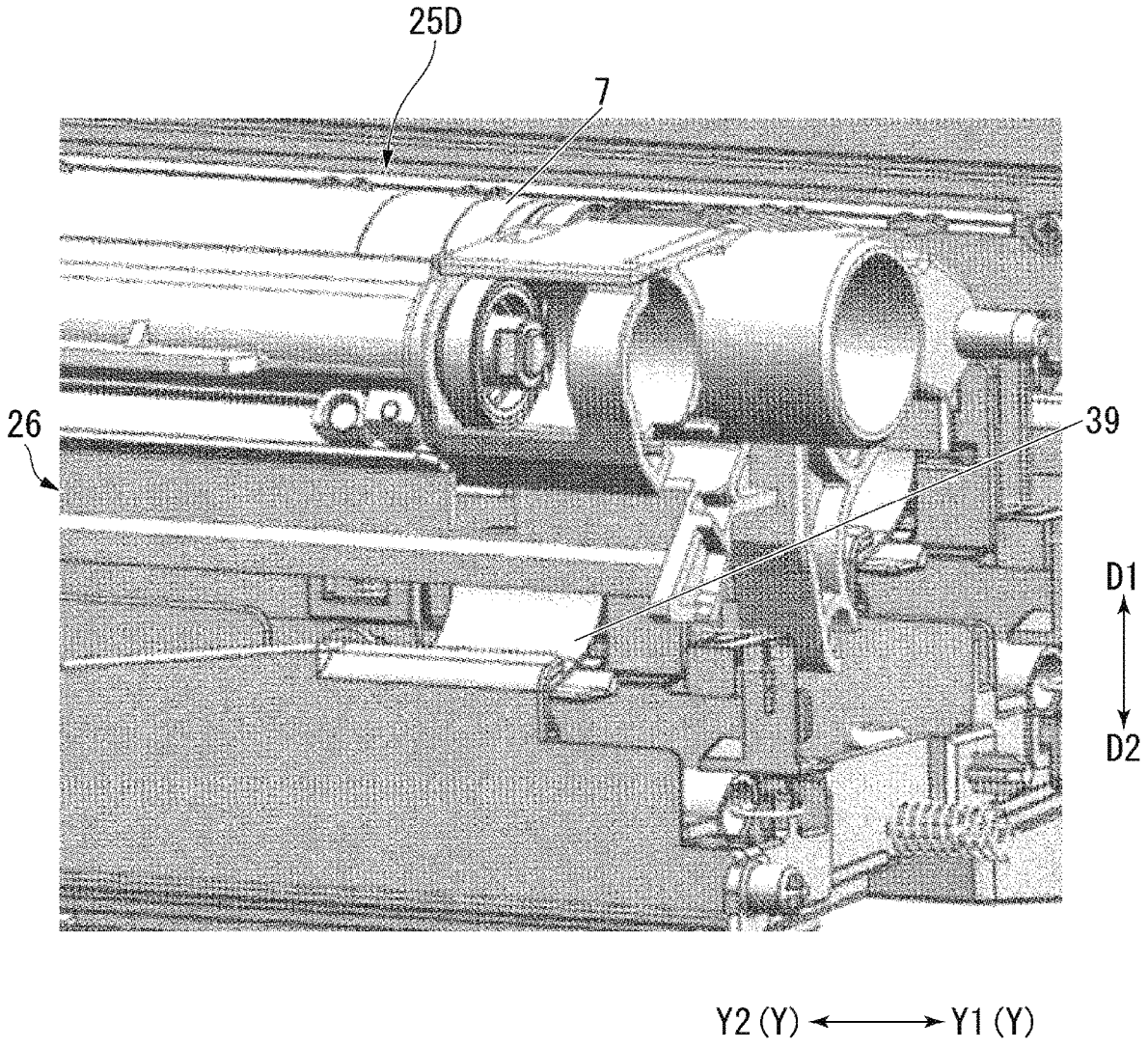
FIG. 4 is a perspective view of the exposure device.
Figure 5:
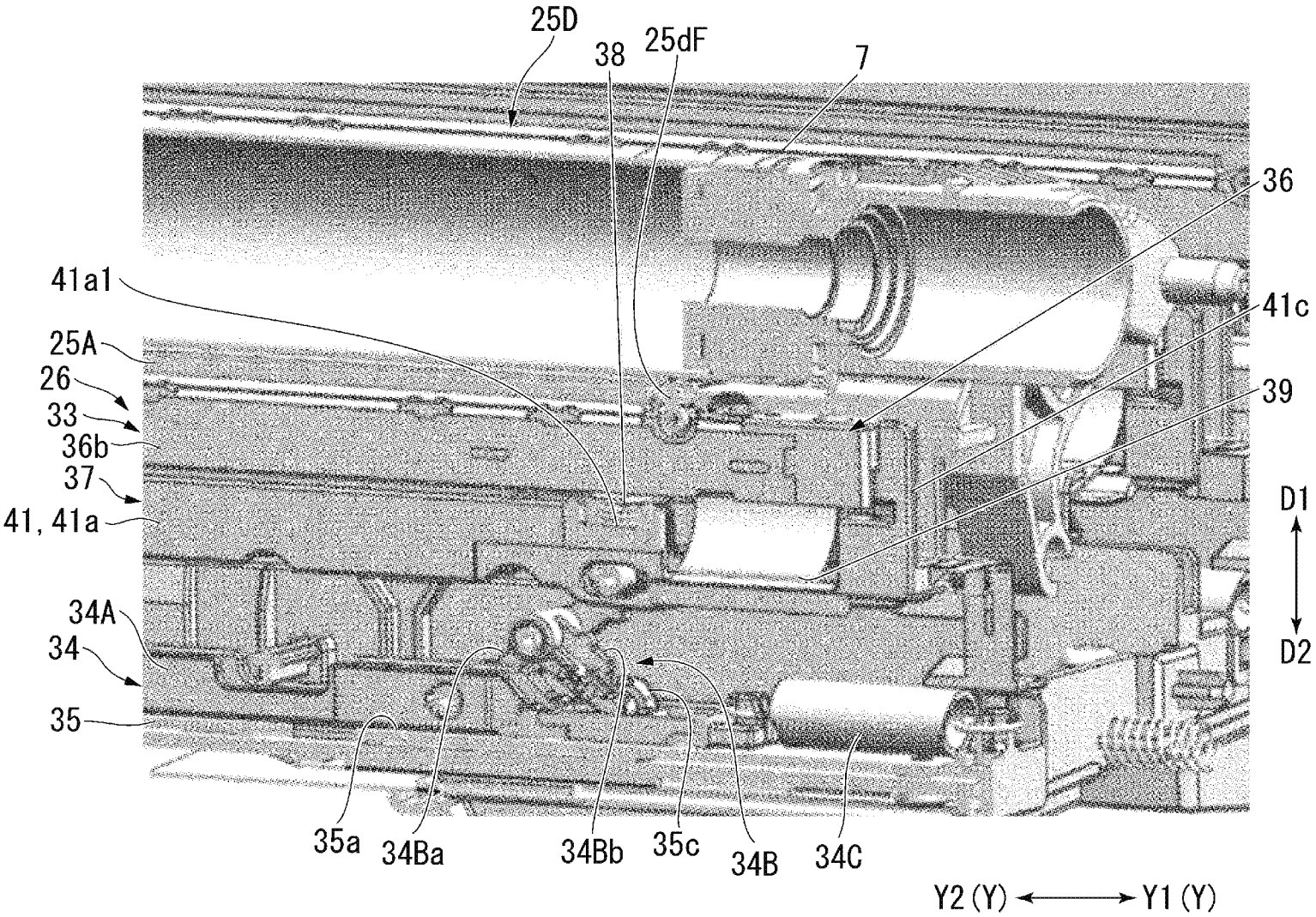
FIG. 5 is a perspective view of a cross section of the exposure device.
Figure 6:
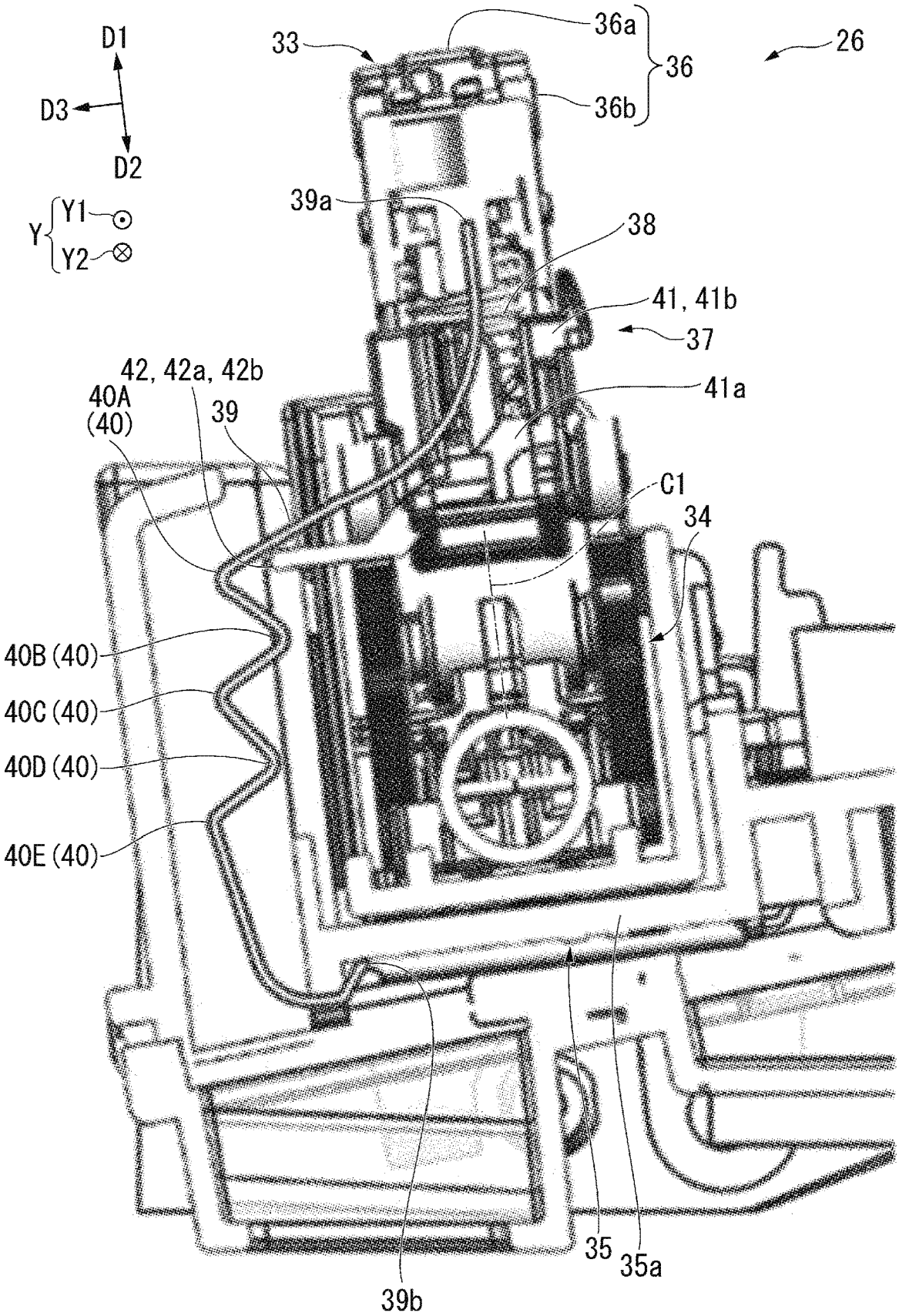
FIG. 6 is a cross-sectional view of the exposure device.

FIG. 2 is a perspective view showing a state where the photosensitive drum unit is pulled out in the image forming apparatus of the embodiment. FIG. 3 is a perspective view of an exposure device and a base in the image forming apparatus of the embodiment. FIG. 4 is a perspective view of the exposure device. FIG. 5 is a perspective view of a cross section of the exposure device. FIG. 6 is a diagram showing a cross section of the exposure device.

As shown by the image forming unit 25Y in FIG. 2, each of the image forming units 25 is unitized as a photosensitive drum unit 25D excluding the exposure devices 26 and the primary transfer rollers. The photosensitive drum unit 25D can be pulled out in the Y1 direction in a state where the exposure devices 26 and the primary transfer rollers are left inside the printer unit 3.

Each of the exposure devices 26 is on a base 11 provided in the printer unit 3.

As shown in FIG. 3, the plurality of exposure devices 26 are spaced from each other in the X direction on the base 11. Each position of the exposure devices 26 in the X direction corresponds to an exposure position to each of the photosensitive drums 7. The height of each lower surface of the exposure devices 26 is positioned by the base 11.

As shown in FIGS. 4 and 5, the exposure device 26 includes an exposure unit 33 (see FIG. 5), a lifting mechanism 34 (see FIG. 5), and a support member 35 (see FIG. 5). The exposure unit 33 forms an electrostatic latent image on the photosensitive drum 7.

As shown in FIG. 6, the exposure unit 33 includes an exposure head 36, a holder unit 37, a biasing member 38, and a harness 39.

The exposure head 36 includes an exposure device 36*a* and a head body 36*b*.

The exposure device 36*a* has a length in the Y direction. The exposure device 36*a* includes a plurality of light emitting elements and a circuit board that causes the light emitting elements to emit light. For example, the plurality of light emitting elements are a solid-state light emitting element array. The plurality of light emitting elements are arranged in the longitudinal direction of the head body 36*b*. For example, the plurality of light emitting elements may be an LED array or an organic EL array. The plurality of light emitting elements in the exposure device 36*a* emit light in response to a drive current from the circuit board.

The exposure device 36*a* includes a lens that collects light from the plurality of light emitting elements. The lenses focus the light from the plurality of light emitting elements in a spot shape at respective focal positions. The lens is not particularly limited as long as the lens can collect light from the plurality of light emitting elements independently. For example, the lens is a SELFOC lens array (registered trademark).

The head body 36*b* holds the exposure device 36*a*. The head body 36*b* has a length in the Y direction (see FIG. 5). The head body 36*b* is supported by a holder 41 of the holder unit 37 so as to be movable in a first direction D1 and a second direction D2. The first direction D1 is a direction of approaching the photosensitive drum 7 (see FIG. 5). The second direction D2 is a direction opposite to the first direction D1. The second direction D2 is a direction of being spaced from the photosensitive drum 7 (see FIG. 5). The first direction D1 and the second direction D2 are directions along an optical axis of the light emitted from the exposure device 36*a*. A third direction D3 is a direction orthogonal to the first direction D1 and the Y direction.

The length direction of the exposure head 36 is a direction intersecting the first direction D1 and the third direction D3. In the present embodiment, the length direction of the exposure device 26 is a direction orthogonal to the first direction D1 and the third direction D3.

C1 is a center line of the exposure head 36. C1 is parallel to the first direction D1 and is a line passing through the center of the thickness direction (the third direction D3) of the exposure head 36.

The incident angle of the optical axis with respect to the surface of the photosensitive drum 7 is not particularly limited. For example, the optical axis may be inclined with respect to the normal line at the incident position on the photosensitive drum 7.

As shown in FIG. 5, a portion of the end surface of the head body 36*b* in the first direction D1 is a contact surface (not shown) that is in contact with a spacer 25*d*F. The spacer 25*d*F is provided in a case 25A of the photosensitive drum unit 25D. When the spacer 25*d*F is in contact with the head body 36*b*, a certain gap is formed between the case 25A and the head body 36*b*. This gap is determined so that the focal position of the lens of the exposure head 36 matches the surface of the photosensitive drum 7.

The exposure head 36 is positioned so that the focal position of the lens matches the surface of the photosensitive drum 7 by the contact with the spacer 25*d*F.

As shown in FIG. 6, for example, the harness 39 is a signal line that sends a signal (such as a drive signal) to the exposure device 36*a*. The harness 39 has a tape shape in which a plurality of signal lines are arranged in the Y direction. The harness 39 may be a power supply line for supplying power to the exposure head 36.

A one end portion 39*a* of the harness 39 is connected to the exposure head 36. The other end portion of the harness 39 is connected to a control substrate provided in the image forming apparatus 100.

The harness 39 is positioned with respect to the support member 35 in a positioning location 39*b* having a length direction position different from that of the one end portion 39*a*. For example, the positioning location 39*b* is positioned in a bottom surface portion 35*a*. The positioning location 39*b* may be fixed to the support member 35. The positioning location 39*b* may be a location positioned by being locked to the support member 35.

The harness 39 includes one or a plurality of folding portions 40 between the one end portion 39*a* and the positioning location 39*b*. According to the present embodiment, the harness 39 includes five folding portions 40. The folding portion 40 is a portion including a location where the harness 39 is bent. According to the present embodiment, the five folding portions 40 are the first forward folding portion 40A, the first reverse folding portion 40B, the second forward folding portion 40C, the second reverse folding portion 40D, and the third forward folding portion 40E in order from the folding portion 40 close to the one end portion 39*a*.

The first forward folding portion 40A, the second forward folding portion 40C, and the third forward folding portion 40E are portions including a mountain-folded (convex, inverted V-shaped) bent portion. For example, the forward folding portions 40A, 40C, and 40E include a portion in which the harness 39 extends obliquely outward and downward, and the direction thereof is converted toward obliquely inward and downward by the bending. The "obliquely outward and downward" is a direction toward the outside (a direction away from the center line C1 of the exposure head 36) while descending. The "obliquely inward and downward" is a direction inward (a direction of approaching the center line C1) while descending.

The first reverse folding portion 40B and the second reverse folding portion 40D are portions including a valley-folded (concave, V-shaped) bent portion. For example, the reverse folding portions 40B and 40D include a portion in which the harness 39 extends obliquely inward and downward, and the direction thereof is converted toward obliquely outward and downward by the bending.

In addition to the first forward folding portion 40A, the harness 39 includes the first reverse folding portion 40B, the second forward folding portion 40C, the second reverse folding portion 40D, and the third forward folding portion 40E between the first forward folding portion 40A and the positioning location 39*b*. Therefore, the size of the harness 39 in a portion between the first forward folding portion 40A and the positioning location 39*b* can be reduced. Therefore, the harness 39 can be wired in a small space.

The number of folding portions between the first forward folding portion and the positioning location is not particularly limited. The number of folding portions between the first forward folding portion and the positioning location can be one or more.

The holder unit 37 includes the holder 41 and a protrusion 42.

The holder 41 includes a bottom portion 41*a*, a pair of side walls 41*b*, and a pair of end walls 41*c* (see FIG. 5).

The holder 41 has a length in the Y direction. The length direction of the holder 41 is a direction intersecting the first direction D1 and the third direction D3. According to the present embodiment, the length direction of the holder 41 is a direction orthogonal to the first direction D1 and the third direction D3.

A receiving surface 41*a*1 of the bottom portion 41*a* (see FIG. 5) is a surface facing the head body 36*b* of the exposure head 36.

The pair of side walls 41*b* protrude in the first direction D1 from both side edges of the bottom portion 41*a*. The side walls 41*b* regulate the lateral displacement of the exposure head 36. This "lateral" is a direction orthogonal to the first direction D1 and the Y direction.

The pair of end walls 41*c* (see FIG. 5) protrude from the both ends of the bottom portion 41*a* in the first direction D1. The end walls 41*c* regulate the displacement of the exposure head 36 in the longitudinal direction (Y direction).

The holder 41 supports the exposure head 36 movably in the first direction D1 and the second direction D2.

The protrusion 42 is a projection that protrudes outward from the outer surface of the end portion of the side walls 41*b* of the holder 41 in the second direction D2. The protrusion 42 protrudes in a direction which intersects the first direction D1 and is away from the holder 41. For example, the protrusion 42 protrudes in the third direction D3. For example, the protrusion 42 has a plate shape having a length in the length direction of the exposure head 36 and the holder 41.

The protrusion 42 extends toward the first forward folding portion 40A. A tip portion 42*a* of the protrusion 42 enters the inside of the first forward folding portion 40A. A distance between the tip portion 42*a* and the center line C1 is larger than a distance between the first reverse folding portion 40B and the center line C1.

Since the tip portion 42*a* enters the inside of the first forward folding portion 40A, the protrusion 42 can regulate the movement of the harness 39 in a portion including the first forward folding portion 40A in the first direction D1 or the second direction D2.

Since the protrusion 42 has a plate shape having a length in the length direction of the exposure head 36 and the holder 41, the movement of the harness 39 can be regulated in a wide range in the corresponding direction. Therefore, the movement of the harness 39 can be reliably regulated.

The protrusion 42 may be formed integrally with the holder 41 or may be a separate body from the holder 41.

An end surface 42*b* of the tip portion 42*a* of the protrusion 42 is preferably a curved convex surface. The end surface 42*b* of the tip portion 42*a* may have a semicircular shape, a semielliptic shape, or the like when viewed from the Y direction. When the end surface 42*b* of the tip portion 42*a* has a curved convex surface, even if the harness 39 touches the tip portion 42*a*, the surface of the harness 39 is less likely to be damaged.

The biasing member 38 is between the bottom portion 41*a* of the holder 41 and the exposure head 36. One end of the biasing member 38 is in contact with the receiving surface 41*a*1 of the bottom portion 41*a* (see FIG. 5). The biasing member 38 exerts a reaction force to the bottom portion 41*a* (the receiving surface 41*a*1) to bias the head body 36*b* in the first direction D1. A biasing force of the biasing member 38 is determined so as to press the contact surface of the head body 36*b* to the spacer 25*d*F (see FIG. 5) with a constant load.

The number of the biasing members 38 is not particularly limited. For example, the biasing members 38 can be provided in a plurality of locations with gaps in the longitudinal direction (the Y direction) of the holder 41. The biasing member 38 is not particularly limited as long as the biasing member 38 can bias the holder unit 37. For example, the biasing member 38 may be a coil spring that expands and contracts in the first direction D1 and the second direction D2.

The lifting mechanism 34 supports the exposure unit 33 so as to be capable of moving forward and backward with respect to the photosensitive drum 7. The lifting mechanism 34 supports the exposure unit 33 movably in the first direction D1 and the second direction D2.

For example, FIGS. 4 to 6 show a state where the lifting mechanism 34 raises the exposure unit 33 to the contact position which is the uppermost position. At the contact position, the contact surface of the head body 36*b* is in contact with a spacer 25*d*F (see FIG. 5).

Figure 7:
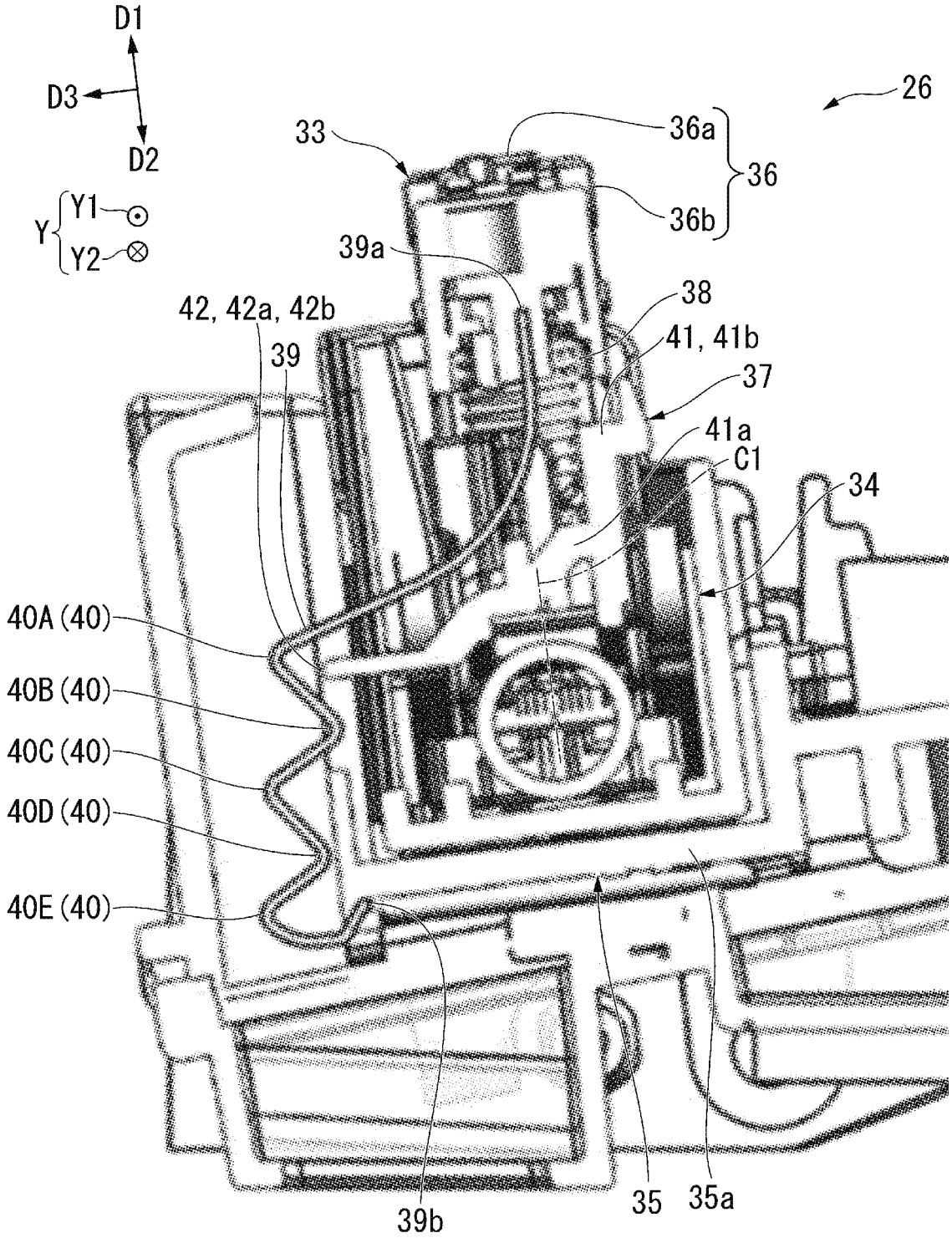
FIG. 7 is a cross-sectional view of the exposure device.

For example, FIG. 7 shows a state where the lifting mechanism 34 lowers the exposure unit 33 to the spaced position which is the lowermost position. In the spaced position, the contact surface of the head body 36*b* is spaced from the spacer 25*d*F (see FIG. 5) and a gap wider than a gap at contact position is formed between the case 25A and the exposure unit 33.

As shown in FIG. 5, the lifting mechanism 34 includes a first link 34A, a link mechanism 34B, and a biasing member 34C.

The first link 34A is provided on the bottom surface portion 35*a* along the longitudinal direction of the bottom surface portion 35*a*. The first link 34A is supported on the bottom surface portion 35*a* movably in the Y direction. When the exposure unit 33 is moved to the contact position, the first link 34A moves the most in the Y2 direction with respect to the support member 35. When the exposure unit 33 is moved to the spaced position, the first link 34A moves the most in the Y1 direction with respect to the support member 35.

The link mechanism 34B is provided between the support member 35 and the exposure unit 33. The link mechanism 34B supports the holder unit 37 of the exposure unit 33. The link mechanism 34B is rotatably connected to the first link 34A. The link mechanism 34B converts the movement of the first link 34A in the Y1 direction to the movement in the first direction D1 to move the holder unit 37 to be spaced from the support member 35 in the first direction D1. The link mechanism 34B converts the movement of the first link 34A in the Y2 direction to the movement in the second direction D2 to move the holder unit 37 in the second direction D2 to approach the support member 35.

The link mechanism 34B includes a second link 34Ba and a third link 34Bb.

The second link 34Ba connects the first link 34A to the bottom portion 41*a* of the holder 41. The second link 34Ba is rotatably connected to the third link 34Bb. The third link 34Bb connects the second link 34Ba to the support member 35. The third link 34Bb is rotatably connected to a support portion 35*c*.

The support member 35 is below the lifting mechanism 34. The support member 35 includes the bottom surface portion 35*a* and the support portion 35*c*. The bottom surface portion 35*a* has a length in the Y direction. The support member 35 supports the lifting mechanism 34 on the bottom surface portion 35*a*. The support portion 35*c* rotatably supports the third link 34Bb of the link mechanism 34B.

The configuration of the link mechanism 34B is not particularly limited as long as the link mechanism 34B can move the exposure unit 33 in the first direction D1 and the second direction D2 in response to the movement of the first link 34A.

The biasing member 34C biases the first link 34A in the Y2 direction in a movement area of the first link 34A. For example, the biasing member 34C may be a tension coil spring that expands and contracts in the Y direction.

The operation of the image forming apparatus 100 is described.

As shown in FIG. 1, in the image forming apparatus 100, the exposure devices 26 are mounted on the base 11 in the printer unit 3 so that the exposure heads 36 are at the contact position. At the contact position, the focal position of the lens is aligned with the surface of the photosensitive drum 7.

Image formation is started by an operation of the control panel 1 or an external signal. The image information is sent to the printer unit 3 by reading the object to be copied by the scanner unit 2 or sent to the printer unit 3 from the outside. The printer unit 3 supplies the sheet P in the sheet supply unit 4 or the sheet P in the manual feed unit 10 to the registration roller 24 based on a control signal generated by the control unit 6 based on an operation of the control panel 1 or an external signal.

When an operation input for forming an image is made from the control panel 1, the control unit 6 performs control, for example, for starting feeding of the sheet P or image formation.

The exposure devices 26 expose each of the photosensitive drums 7 of the image forming units 25Y, 25M, 25C, and 25K based on the image information corresponding to each color sent from the control unit 6 and form electrostatic latent images corresponding to respective pieces of the image information. The electrostatic latent images are developed by the developing devices 8, respectively. Therefore, the toner image corresponding to the electrostatic latent image is formed on each surface of the photosensitive drums 7. Each toner image is primarily transferred to the intermediate transfer belt 27 by each transfer roller. Together with the movement of the intermediate transfer belt 27, the toner images are sequentially superposed on each other without causing color shift and are sent to the transfer unit 28.

The sheet P is fed from the registration roller 24 to the transfer unit 28. The toner image reaching the transfer unit 28 is secondarily transferred to the sheet P. Since the secondarily transferred toner image is fixed to the sheet P by the fixing device 29, the image is formed on the sheet P.

As shown in FIG. 5, in order to dispose the exposure head 36 at the contact position, the exposure unit 33 connected to the second link 34Ba is raised to reach the contact position by the link mechanism 34B. In order to move the exposure head 36 from the contact position to the spaced position, the second link 34Ba is brought close to horizontal.

In the exposure device 26, the tip portion 42*a* of the protrusion 42 enters the inside of the first forward folding portion 40A, and the movement of the harness 39 in this portion in the first direction D1 or the second direction D2 is regulated. Since the posture of the harness 39 in the area from the exposure head 36 to the first forward folding portion 40A can be stabilized, the force exerted by the harness 39 on the exposure head 36 can be suppressed, and the load applied to the exposure head 36 can be accurately determined.

In the exposure device of the embodiment, the number of folding portions formed in the harness is not particularly limited. The number of folding portions may be one.

According to at least one embodiment described above, the posture of the harness in the area from the exposure head to the first forward folding portion can be stabilized. Therefore, the force exerted by the harness on the exposure head can be suppressed, and the load applied to the exposure head can be accurately determined.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An exposure device, comprising:

an exposure head configured to draw an electrostatic latent image on a photoconductive image carrier;

a holder configured to support the exposure head movably in a first direction approaching the photoconductive image carrier and a second direction spaced apart from the photosensitive drum;

a biasing member configured to exert a force to the holder to bias the exposure head in the first direction;

a lifting mechanism configured to move the holder in the first direction and the second direction;

a support member configured to support the lifting mechanism;

a harness having one end portion connected to the exposure head, positioned with respect to the support member in a positioning location having a length direction position different from that of the one end portion, and having a folding portion formed between the one end portion and the positioning location; and a protrusion configured to enter inside of the folding portion to regulate movement of the folding portion of the harness in the first direction or the second direction and protrude from the holder in a third direction intersecting the first direction.

2. The exposure device according to claim 1, wherein the exposure head and the holder have lengths in a direction intersecting the first direction and the third direction, and the protrusion has a plate shape having a length in a length direction of the exposure head and the holder.

3. The exposure device according to claim 1, wherein an end surface of a tip portion of the protrusion forms a curved convex surface.

4. The exposure device according to claim 1, wherein the harness further has one or a plurality of folding portions between the folding portion and the positioning location of the harness.

5. The exposure device according to claim 1, further comprising:

a light source in which a plurality of light emitting elements are arranged in a linear direction.

6. The exposure device according to claim 5, further comprising:

a lens that collects light from the plurality of light emitting elements.

7. The exposure device according to claim 1, wherein the photoconductive image carrier is a photosensitive drum.

8. An image forming apparatus, comprising:

a control panel configured to operate the image forming apparatus;

an exposure device comprising:

an exposure head configured to draw an electrostatic latent image on a photoconductive image carrier;

a holder configured to support the exposure head movably in a first direction approaching the photoconductive image carrier and a second direction spaced apart from the photosensitive drum;

a biasing member configured to exert a force to the holder to bias the exposure head in the first direction;

a lifting mechanism configured to move the holder in the first direction and the second direction;

a support member configured to support the lifting mechanism;

a harness having one end portion connected to the exposure head, positioned with respect to the support member in a positioning location having a length direction position different from that of the one end portion, and having a folding portion formed between the one end portion and the positioning location; and a protrusion configured to enter inside of the folding portion to regulate movement of the folding portion of the harness in the first direction or the second direction and protrude from the holder in a third direction intersecting the first direction; and a printer unit configured to form an image on a sheet based on image information.

9. The image forming apparatus according to claim 8, wherein the exposure head and the holder have lengths in a direction intersecting the first direction and the third direction, and the protrusion has a plate shape having a length in a length direction of the exposure head and the holder.

10. The image forming apparatus according to claim 8, wherein an end surface of a tip portion of the protrusion forms a curved convex surface.

11. The image forming apparatus according to claim 8, wherein the harness further has one or a plurality of folding portions between the folding portion and the positioning location of the harness.

12. The image forming apparatus according to claim 8, further comprising:

a light source in which a plurality of light emitting elements are arranged in a linear direction.

13. The image forming apparatus according to claim 12, further comprising:

a lens that collects light from the plurality of light emitting elements.

14. The image forming apparatus according to claim 8, wherein the photoconductive image carrier is a photosensitive drum.

15. The image forming apparatus according to claim 8, further comprising:

a plurality of exposure devices, each exposure device corresponding with a toner type.

16. The image forming apparatus according to claim 8, further comprising:

four exposure devices, each of the four exposure devices corresponding with one of four toner types.

17. The image forming apparatus according to claim 16, wherein the four toner types include cyan toner, yellow toner, magenta toner, and black toner.

18. A method of operating an exposure device, comprising:

drawing an electrostatic latent image on a photoconductive image carrier using an exposure head;

supporting by a holder the exposure head movably in a first direction approaching the photoconductive image carrier and a second direction spaced apart from the photosensitive drum;

exerting a force by a biasing member to the holder to bias the exposure head in the first direction;

moving the holder in the first direction and the second direction using a lifting mechanism;

supporting using a support member the lifting mechanism, wherein a harness having one end portion connected to the exposure head, positioned with respect to the support member in a positioning location having a length direction position different from that of the one end portion, and having a folding portion formed between the one end portion and the positioning location; and entering inside of the folding portion using a protrusion to regulate movement of the folding portion of the harness in the first direction or the second direction and protrude from the holder in a third direction intersecting the first direction.

19. The method according to claim 18, wherein the exposure head and the holder have lengths in a direction intersecting the first direction and the third direction, and the protrusion has a plate shape having a length in a length direction of the exposure head and the holder.

20. The method according to claim 18, wherein an end surface of a tip portion of the protrusion forms a curved convex surface.

* * * * *